US011198164B2

(12) United States Patent
Powers, III

(10) Patent No.: US 11,198,164 B2
(45) Date of Patent: Dec. 14, 2021

(54) TWO-AXIS ROLL FORMING APPARATUS

(71) Applicant: John Powers, III, Phoenix, AZ (US)

(72) Inventor: John Powers, III, Phoenix, AZ (US)

( * ) Notice: Subject to any disclaimer, the term of this patent is extended or adjusted under 35 U.S.C. 154(b) by 265 days.

(21) Appl. No.: 16/520,141

(22) Filed: Jul. 23, 2019

(65) Prior Publication Data

US 2020/0055104 A1 Feb. 20, 2020

Related U.S. Application Data

(60) Provisional application No. 62/702,818, filed on Jul. 24, 2018.

(51) Int. Cl.
*B21D 5/08* (2006.01)
*B21B 1/38* (2006.01)

(52) U.S. Cl.
CPC ..... *B21B 1/38* (2013.01); *B21D 5/083* (2013.01); *B21B 2203/18* (2013.01)

(58) Field of Classification Search
CPC .. B21D 5/08; B21D 5/083; B21D 5/14; B21B 1/085; B21B 1/088; B21B 1/0886; B21B 1/09–098; B21B 1/14; B21B 1/42; B21B 13/12
See application file for complete search history.

(56) References Cited

U.S. PATENT DOCUMENTS 3,051,214 A * 8/1962 Rutten ..... B21D 5/083 72/12.1
3,529,461 A * 9/1970 Knudson ..... B21D 5/08 72/181
3,550,420 A * 12/1970 Swanson ..... B21D 5/08 72/296
5,551,135 A * 9/1996 Powers, III ..... B21D 47/02 29/6.1
2004/0040357 A1* 3/2004 Ingvarsson ..... B21D 5/083 72/181
2009/0205387 A1* 8/2009 Durney ..... B21D 11/08 72/178
2010/0139350 A1* 6/2010 Smith ..... B21D 5/08 72/11.2
2015/0027189 A1* 1/2015 Lee ..... B21D 5/083 72/181
2015/0027641 A1* 1/2015 Lee ..... B21D 5/08 156/443
2016/0258159 A1* 9/2016 Powers, III ..... B21D 5/08

* cited by examiner

*Primary Examiner* — Gregory D Swiatocha
*Assistant Examiner* — Bobby Yeonjin Kim
(74) *Attorney, Agent, or Firm* — Parsons & Goltry; Robert Parsons; Michael Goltry

(57) ABSTRACT

A two-axis roll forming apparatus for forming sheet metal includes a first carriage and a second carriage each reciprocally movable parallel to a longitudinal axis. The second carriage is spaced apart from the first carriage and separated therefrom by a gap. A first bending station is carried by the first carriage and reciprocal moveable parallel to a transverse axis which is perpendicular to the longitudinal axis. A second bending station is carried by the second carriage and reciprocal moveable parallel to the transverse axis which is perpendicular to the longitudinal axis.

10 Claims, 4 Drawing Sheets

TWO-AXIS ROLL FORMING APPARATUS

CROSS-REFERENCE TO RELATED APPLICATIONS

This application claims the benefit of U.S. Provisional Patent Application No. 62/702,818, filed 24 Jul. 2018.

FIELD OF THE INVENTION

This invention relates to sheet metal roll forming apparatus.

More particularly, the present invention relates to roll forming apparatus for forming irregular beams.

BACKGROUND OF THE INVENTION

In the field of metal roll forming, straight line bends are formed in sheet metal using a plurality of forming rollers. Conventional roll forming typically employ a plurality of forming rollers in a line through which a sheet of metal is passed. Each forming roller is fixed at a specific angle and incrementally bends the sheet of material as it passes through. Forming rollers in the line are fixed at incrementally greater angles and progressively bend the metal sheet to a desired angle along a straight line. Thus, conventionally, a sheet of metal is passed through a series of linear, forming rollers to produce a straight-line bend. A straight-line bend is intended to describe a bend in the sheet metal which extends from one end to the other in a straight line.

It would be highly advantageous, therefore, to remedy the foregoing and other deficiencies inherent in the prior art.

An object of the present invention is to provide a roll forming apparatus that can form straight-line or non-straight-line bends.

Another object of the present invention is to provide a roll forming apparatus having adjustable forming rollers.

Yet another object of the present invention is to provide a roll forming apparatus that passes the forming rollers along the sheet material.

And another object of the present invention is to provide a roll forming apparatus that can be employed on two axes.

SUMMARY OF THE INVENTION

Briefly, to achieve the desired objects and advantages of the instant invention, provided is a two-axis roll forming apparatus for forming sheet metal. The two-axis roll forming apparatus includes a first carriage reciprocally movable parallel to a longitudinal axis and a second carriage reciprocally movable parallel to the longitudinal axis, the second carriage spaced apart from the first carriage and separated therefrom by a gap. A first bending station is carried by the first carriage, the first bending station reciprocal moveable parallel to a transverse axis which is perpendicular to the longitudinal axis, and a second bending station carried by the second carriage, the second bending station reciprocal moveable parallel to the transverse axis which is perpendicular to the longitudinal axis.

In a further aspect, a two-axis roll forming apparatus for forming sheet material includes a first longitudinal track having opposing ends, and a second longitudinal track having opposing ends, the second longitudinal track positioned parallel to the first longitudinal track with a gap therebetween. The gap defines a longitudinal axis parallel to the first longitudinal track and the second longitudinal track. A platform is positioned in the gap between the first longitudinal track and the second longitudinal track for holding sheet material. A first carriage is carried by and reciprocally movable along the first longitudinal track parallel to the longitudinal axis. A second carriage is carried by and reciprocally movable along the second longitudinal track parallel to the longitudinal axis. The second carriage is separated from the first carriage and by the gap. A first bending station is carried by the first carriage and is reciprocal moveable parallel to a transverse axis which is perpendicular to the longitudinal axis. The first bending station includes a frame, a base roller carried by the frame, and a forming roller carried by the frame and positioned above the base roller at an angle relative the base roller. The angle of the forming roller is incrementally adjustable. A second bending station is carried by the second carriage. The second bending station is reciprocal moveable parallel to the transverse axis which is perpendicular to the longitudinal axis. The second bending station includes a frame, a base roller carried by the frame, and a forming roller carried by the frame and positioned above the base roller at an angle relative the base roller. The angle of the forming roller is incrementally adjustable.

A method of forming sheet metal using a two-axis roll forming apparatus is provided. The method includes providing a sheet of metal and providing a two-axes roll forming apparatus. The sheet of metal is positioned on the platform. The forming roller of the first bending station and the forming roller of the second bending station are set to a starting angle. An initial bend is created at a first edge of the sheet of metal by moving the first bending station along a pathway overlying and spaced apart from the first edge of the sheet of metal. An initial bend is created at a second edge of the sheet of metal by moving the second bending station along a pathway overlying and spaced apart from the second edge of the sheet of metal concurrent with the first bending station.

In further steps of the method, the angle of the forming roller of the first bending station and the forming roller of the second bending station are incrementally adjusted to a second angle. The initial bend at the first edge of the sheet of metal is increased by moving the first bending station along the pathway overlying and spaced apart from the first edge of the sheet of metal. The initial bend at the second edge of the sheet of metal is increased by moving the second bending station along the pathway overlying and spaced apart from the second edge of the sheet of metal concurrent with the first bending station. Moving the first and second bending stations along the pathway includes moving the first carriage along the first longitudinal track and concurrently moving the first bending station parallel to the transverse axis, and moving the second carriage along the second longitudinal track and concurrently moving the second bending station parallel to the transverse axis.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
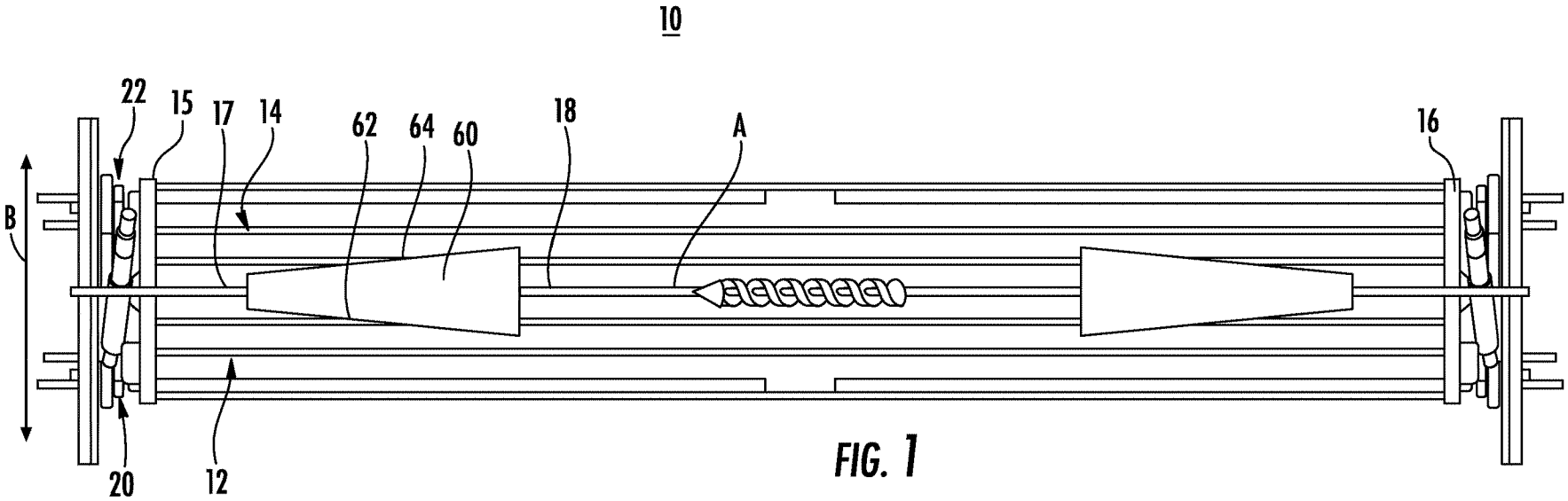
FIG. 1 is a perspective view of a two-axis roll forming apparatus according to the present invention.
Figure 2:
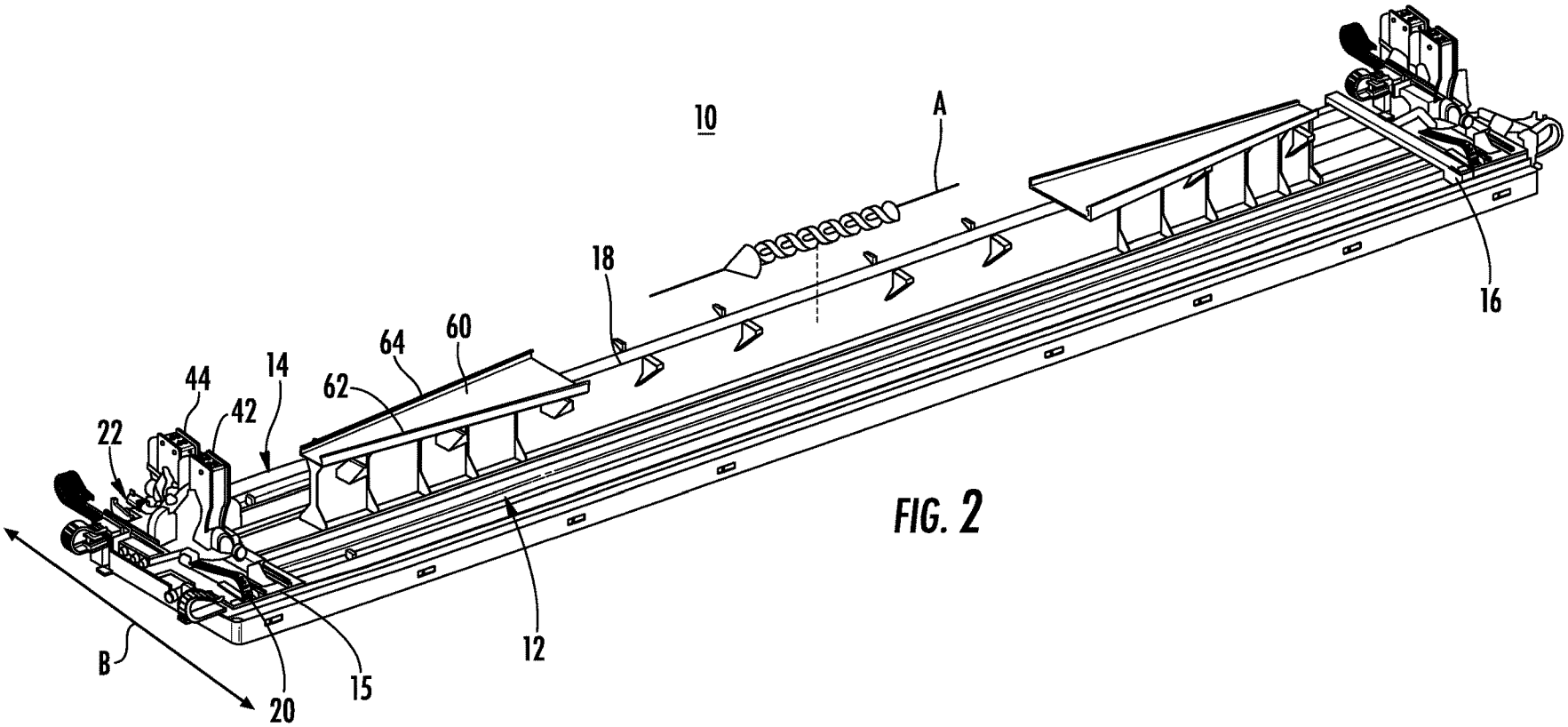
FIG. 2 is a top view of the two-axis roll forming apparatus of FIG. 1.
Figure 3:
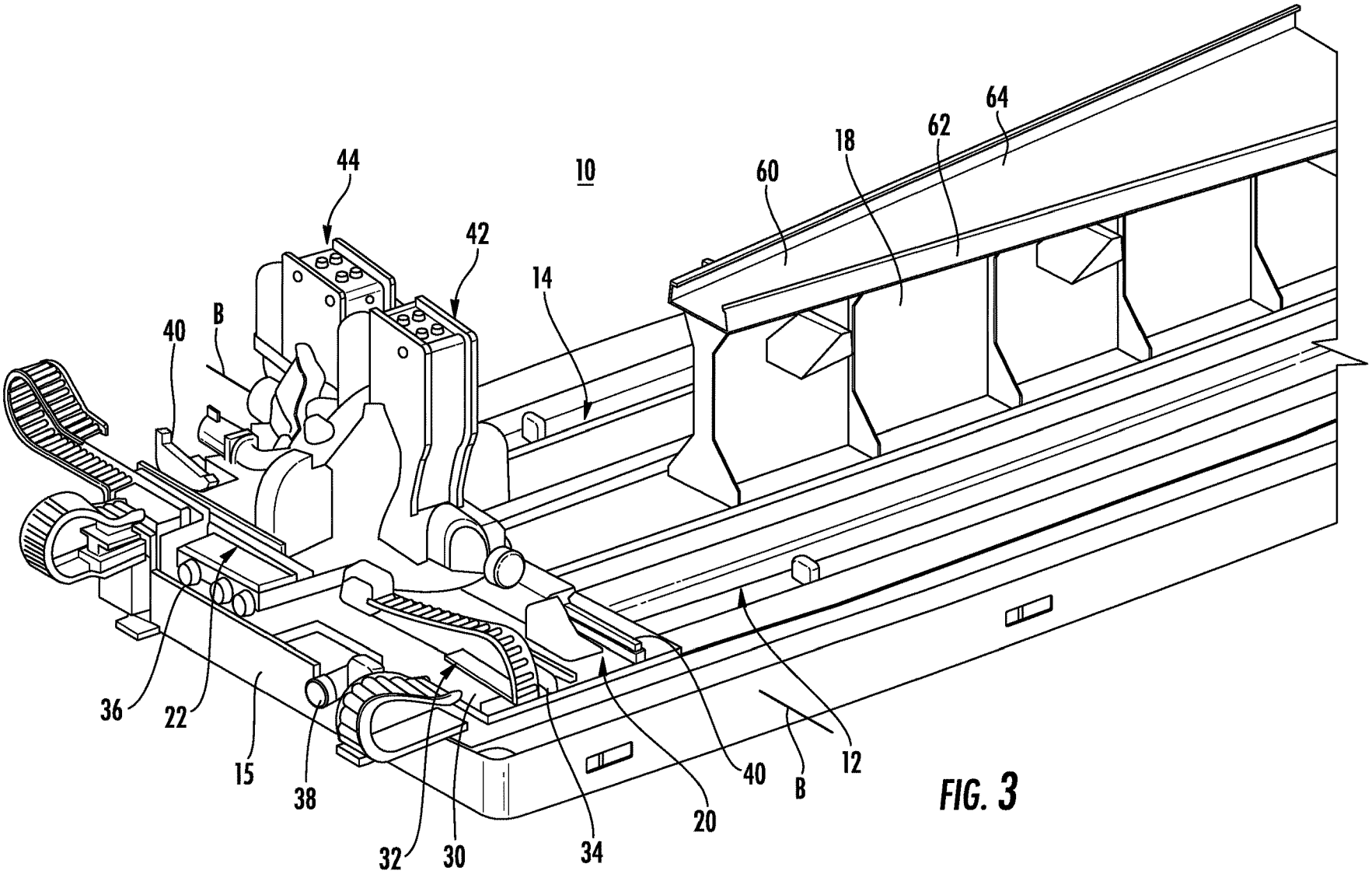
FIG. 3 is an enlarged partial view of the two-axis roll forming apparatus of FIG. 1.

Turning now to the drawings in which like reference characters indicate corresponding elements throughout the several views, attention is directed to FIGS. 1, 2 and 3, which illustrate a two-axis roll forming apparatus, generally designated 10. Two-axis roll forming apparatus 10 is employed to form straight line bends, and non-straight-line bends, which can include divergent bends, convergent bends or combinations thereof, and the like, in sheet metal. Two-axis roll forming apparatus 10 includes a pair of parallel tracks 12 and 14. Each of tracks 12 and 14 have an end 15 and an opposing end 16. Tracks 12 and 14 extend parallel to a longitudinal axis A and are separated by a gap 17. A platform 18 is positioned in gap 17 between tracks 12 and 14. In the preferred embodiment, platform 18 extends parallel to longitudinal axis A and terminates proximate ends 15 and ends 16. However, it will be understood that platform 18 can include multiple portions or a single portion. A carriage 20 is carried by and reciprocally movable along track 12. A carriage 22 is carried by and reciprocally movable along track 14 facing and opposed to carriage 20, separated therefrom by gap 17. Thus, carriages 20 and 22 are movable parallel to longitudinal axis A on opposing sides of platform 18.

Carriages 20 and 22 each include a base 30 having a top surface 32 and a bottom surface 34. Each bottom surface 34 includes a rail engagement assembly 36 which engages and permits stable and controllable reciprocating movement along tracks 12 and 14 for carriages 20 and 22, respectively. A drive mechanism 38 is coupled to and drives each base 30 in a controllable reciprocating movement along tracks 12 and 14 for carriages 20 and 22 respectively. Drive mechanism 38 can be any of a multitude of well know drive mechanisms, such as chain or belt drive mechanisms, screw drive mechanisms and the like, powered by an electric motor and the like. Transverse tracks 40 are carried by top surface 32 of base 30 for each carriage 20 and 22. Tracks 40 are perpendicular to and extend across tracks 12 and 14, parallel to a transverse axis B which is perpendicular to longitudinal axis A. A bending station 42 is carried by carriage 20 and a bending station 44 is carried by carriage 22. Each bending station 42 and 44 is mounted, for reciprocal movement, to tracks 40 of carriages 20 and 22, respectively. A drive mechanism 45 is coupled to and drives each bending station 42 and 44 in a controllable reciprocating movement along tracks 40. Drive mechanism 45 can be any of a multitude of well know drive mechanisms, such as chain or belt drive mechanisms, screw drive mechanisms and the like, powered by an electric motor and the like. Thus, in operation, bending stations 42 and 44 can be moved inwardly toward each other (toward gap 17) and outwardly away from each other (away from gap 17) on tracks 40. Bending stations 42 and 44 can also be moved with carriages 20 and 22, respectively, along tracks 12 and 14 from end 15 to end 16, providing movement along two axes, longitudinal axis A and transverse axis B.

Figure 4:
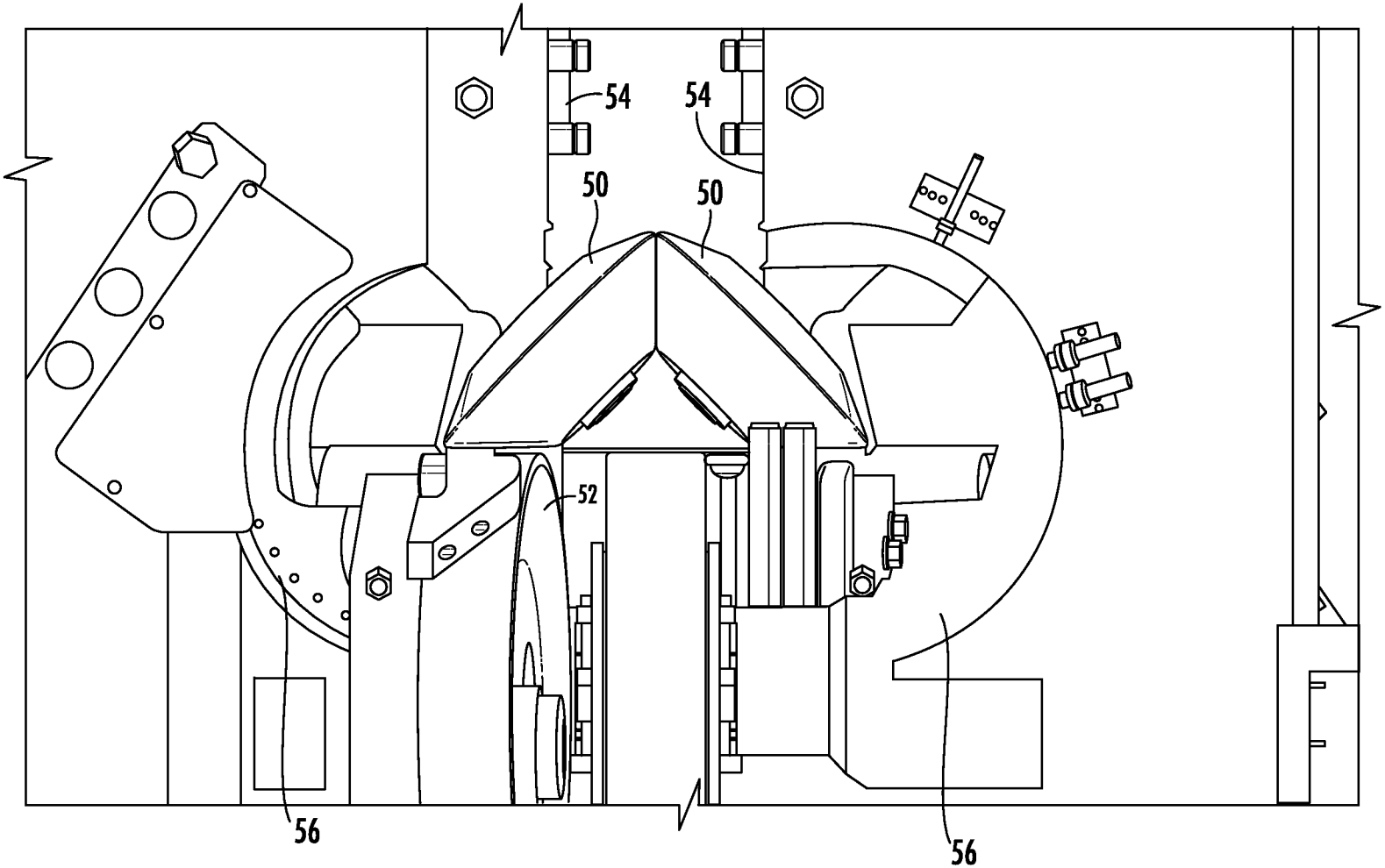
FIG. 4 is an enlarged view of opposed bending stations according to the present invention.

Still referring to FIG. 3, with additional reference to FIG. 4, each bending station includes a forming roller 50 carried above a base roller 52. A frame 54 carries both with forming roller 50 carried above the base roller 52. Frame 54 is reciprocated along track 40 by drive mechanism 45. Forming roller 50 is coupled to frame 54 by a rotatable gear segment 56. Gear segment 56 allows forming roller 50 to be adjusted to different angles relative to base roller 52. As gear segment 56 is rotated on frame 54, forming roller 50 will bend sheet metal to a greater or lesser degree. Forming roller 50 has a start orientation, wherein a small bend will be introduced to sheet metal, and progresses to an end orientation, wherein the final portion of a full bend is applied to the sheet metal. From the start orientation, forming roller is incrementally adjusted by rotating gear segment 56 until the desired bend angle of the sheet metal is achieved.

Referring back to FIGS. 1-3, in operation, a piece 60 of sheet metal is positioned on platform 18. Piece 60 can be secured in different manners, but in the preferred embodiment, platform 18 carries a magnet embedded in the top thereof. The magnet secures piece 60, with opposing edges 62 and 64 extending outwardly therefrom. Piece 60 can be pre-cut in the shape of a truncated triangle, truncated diamond, rectangle and the like, depending on the desired finished shape. As can be seen, a truncated triangle is employed in this example. As carriages 20 and 22 move alongside platform 18 parallel to longitudinal axis A, forming rollers 50 engage piece 60 proximate sides 62 and 64. Since sides 62 and 64 diverge, and are not parallel to longitudinal axis A, to maintain a constant bend distance from edges 62 and 64, as carriages 20 and 22 move along longitudinal axis A bending stations 42 and 44 must concurrently move outwardly parallel to transverse axis B following edges 62 and 64. In this manner, a diverging bend is produced. Once a pass, the desired length of piece 60 has been performed, carriages 20 and 22 are returned to a starting position and gear segment 56 is rotated to position forming roller 50 in a subsequent bending position to produce the next bend increment. The adjustment can occur at a single end to allow for two passes at the same angle, or the adjustment can be made when the carriages reach the opposing end. Carriages 20 and 22 then move bending stations 42 and 44 along edges 62 and 64 to bend piece 60 another increment. This process is continued, repositioning forming roller 50 to incrementally increase the bend for each pass.

It will be understood that while diverging edges were illustrated, diverging, converging, straight or combinations of all can be utilized in the present invention. This is accomplished by the two-axis movement generated by carriages 20 and 22 moving parallel to longitudinal axis A and concurrent movement of bending stations 42 and 44 additionally moving parallel to transverse axis B. Additionally, while carriages 20 and 22 preferably work in tandem, they can also work independently to produce bends with different profiles on the different sides.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A two-axis roll forming apparatus for forming sheet metal comprising:

a first carriage reciprocally movable parallel to a longitudinal axis;

a second carriage reciprocally movable parallel to the longitudinal axis, the second carriage spaced apart from the first carriage and separated therefrom by a gap;

a first bending station carried by the first carriage, the first bending station reciprocal moveable parallel to a transverse axis which is perpendicular to the longitudinal axis;

a second bending station carried by the second carriage, the second bending station reciprocal moveable parallel to the transverse axis which is perpendicular to the longitudinal axis; and each of the first bending station and the second bending station further include a frame, a base roller carried by the frame, a forming roller carried by the frame and positioned above the base roller at an angle relative the base roller, the angle of the forming roller incrementally adjustable.

2. The two-axis roll forming apparatus as claimed in claim 1 further comprising:

a first longitudinal track having opposing ends and extending parallel to the longitudinal axis, the first longitudinal track receiving the first carriage for reciprocating movement thereon; and a second longitudinal track having opposing ends and extending parallel to the longitudinal axis, the second longitudinal track receiving the second carriage for reciprocating movement thereon.

3. The two-axis roll forming apparatus as claimed in claim 2 wherein each of the first carriage and the second carriage further comprising:

a base having a top surface and a bottom surface;

a rail engagement assembly carried by the bottom surface which engages one of the first longitudinal track and the second longitudinal track, and permits stable and controllable reciprocating movement therealong; and a drive mechanism coupled to the base for reciprocating movement of the base parallel to the longitudinal axis.

4. The two-axis roll forming apparatus as claimed in claim 1 wherein each of the first bending station and the second bending station further comprising a rotatable gear segment coupling the forming roller to the frame thereby allowing the forming roller to be adjusted to different angles relative to the base roller.

5. The two-axis roll forming apparatus as claimed in claim 1 wherein each of the first carriage and the second carriage further comprising:

a first transverse track carried by the first carriage, the first transverse track parallel to the transverse axis and perpendicular to the first longitudinal track;

a second transverse track carried by the second carriage, the second transverse track parallel to the transverse axis and perpendicular to the second longitudinal track;

the first bending station carried by and reciprocal moveable along the first transverse track; and the second bending station carried by and reciprocal moveable along the second transverse track.

6. The two-axis roll forming apparatus as claimed in claim 1 wherein each of the first carriage and the second carriage further comprising:

a first drive mechanism coupled to and driving the first bending station in a controllable reciprocating movement along the first transverse track; and a second drive mechanism coupled to and driving the second bending station in a controllable reciprocating movement along the second transverse track.

7. A two-axis roll forming apparatus for forming sheet metal comprising:

a first longitudinal track having opposing ends;

a second longitudinal track having opposing ends, the second longitudinal track positioned parallel to the first longitudinal track with a gap therebetween;

the gap defines a longitudinal axis parallel to the first longitudinal track and the second longitudinal track;

a platform positioned in the gap between the first longitudinal track and the second longitudinal track for holding sheet material;

a first carriage carried by and reciprocally movable along the first longitudinal track parallel to the longitudinal axis;

a second carriage carried by and reciprocally movable along the second longitudinal track parallel to the longitudinal axis, the second carriage separated from the first carriage by the gap;

a first bending station carried by the first carriage, the first bending station reciprocal moveable parallel to a transverse axis which is perpendicular to the longitudinal axis, the first bending station further comprising:

a frame;

a base roller carried by the frame; and a forming roller carried by the frame and positioned above the base roller at an angle relative the base roller, the angle of the forming roller incrementally adjustable; and a second bending station carried by the second carriage, the second bending station reciprocal moveable parallel to the transverse axis which is perpendicular to the longitudinal axis, the second bending station further comprising:

a frame;

a base roller carried by the frame; and a forming roller carried by the frame and positioned above the base roller at an angle relative the base roller, the angle of the forming roller incrementally adjustable.

8. The two-axis roll forming apparatus as claimed in claim 7 wherein each of the first carriage and the second carriage further comprising:

a base having a top surface and a bottom surface;

a rail engagement assembly carried by the bottom surface which engages one of the first longitudinal track and the second longitudinal track and permits stable and controllable reciprocating movement therealong; and a drive mechanism coupled to the base for reciprocating movement of the base parallel to the longitudinal axis.

9. The two-axis roll forming apparatus as claimed in claim 8 wherein each of the first carriage and the second carriage further comprising:

a first transverse track carried by the top surface of the base of the first carriage, the first transverse track being parallel to the transverse axis and perpendicular to the first longitudinal track;

a second transverse track carried by the top surface of the base of the second carriage, the second transverse track being parallel to the transverse axis and perpendicular to the second longitudinal track;

the first bending station carried by and reciprocal moveable along the first transverse track;

a first drive mechanism coupled to and driving the first bending station in a controllable reciprocating movement along the first transverse track;

the second bending station carried by and reciprocal moveable along the second transverse track; and a second drive mechanism coupled to and driving the second bending station in a controllable reciprocating movement along the second transverse track.

10. The two-axis roll forming apparatus as claimed in claim 7 wherein each of the first bending station and the second bending station further comprising a rotatable gear segment coupling the forming roller to the frame thereby allowing the forming roller to be adjusted to different angles relative to the base roller.

* * * * *